US007331824B2

(12) United States Patent
Lin

(10) Patent No.: US 7,331,824 B2
(45) Date of Patent: Feb. 19, 2008

(54) CABLE CONNECTOR ASSEMBLY WITH WIRE SPACER

(75) Inventor: Yuan-Chieh Lin, Lake Forest, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 15 days.

(21) Appl. No.: 11/476,295

(22) Filed: Jun. 28, 2006

(65) Prior Publication Data

US 2006/0286871 A1 Dec. 21, 2006

Related U.S. Application Data

(63) Continuation-in-part of application No. 11/144,114, filed on Jun. 3, 2005, now Pat. No. 7,128,614.

(51) Int. Cl.
*H01R 27/02* (2006.01)

(52) U.S. Cl. ..... 439/638; 439/470

(58) Field of Classification Search ..... 439/67, 439/77, 449, 492, 493, 470, 502, 607–610, 439/638

See application file for complete search history.

(56) References Cited

U.S. PATENT DOCUMENTS

| | | | | |
|---|---|---|---|---|
| 5,816,861 | A * | 10/1998 | Cheng | 439/653 |
| 6,050,831 | A * | 4/2000 | Wu et al. | 439/76.1 |
| 6,796,844 | B1 * | 9/2004 | Edwards, III | 439/638 |
| 6,881,098 | B2 * | 4/2005 | Jeansonne et al. | 439/638 |
| 6,923,683 | B2 * | 8/2005 | Dulai et al. | 439/638 |
| 6,939,177 | B2 * | 9/2005 | Kato et al. | 439/638 |
| 6,948,949 | B1 * | 9/2005 | Schwartz et al. | 439/76.1 |

* cited by examiner

*Primary Examiner*—Khiem Nguyen
(74) *Attorney, Agent, or Firm*—Wei Te Chung

(57) ABSTRACT

An cable connector assembly (500) for high-speed transmission includes a first electrical connector (1) defining a first mating port, a second electrical connector (2) defining a second mating port different from the first mating port (100), cable means (3) electrically connected to the first electrical connector (1) and the second electrical connector (2), and a plurality of wire spacers (5) used for fixing the wires of cable means (3) so as to trim and solder them easily.

19 Claims, 10 Drawing Sheets

CABLE CONNECTOR ASSEMBLY WITH WIRE SPACER

CROSS-REFERENCE TO RELATED APPLICATION

This application is a continuation-in-part (CIP) of U.S. patent application Ser. No. 11/144,114 filed on Jun. 3, 2005 now U.S. Pat. No. 7,128,614, invented by Jerry Wu, entitled "ELECTRICAL ADAPTER WITH REINFORCING MEMBER", which is assigned to the same assignee as this application.

BACKGROUND OF THE INVENTION

1. Field of the Invention

The present invention generally relates to a cable connector assembly, and more particularly to a cable connector assembly used for high speed transmission.

2. Description of Related Art

A cable connector assembly usually includes a cable including some discrete wires arranged in a side-by-side manner with relative high-density and at least an electrical connector connecting with the wires. The cable connector assembly generally comprises a spacer/cable holder/cable organizer for holding cables/wires to make it easy to trim and connect cables/wires to the electrical connecter. U.S. Pat. No. 6,203,376 B1 discloses a cable wafer connector with an integrated strain relief. The strain relief includes a cable clamp having a series of grooves that are separated by intervening land portions. The grooves receive a plurality of cables and space them in a particular spacing. The leads of the cables are terminated to corresponding tail portions. U.S. Pat. No. 6,939,165 B1 discloses a cable holder that can reliably hold plural different types of cables together in an array in side-by-side parallel relationship and includes a pair of hermaphroditic half receiving chambers. The half receiving chambers are separated from each other by interventing land portions. U.S. Pat. No. 5,992,802 discloses a support for a plurality of parallel rows coaxial cables made up of pairs of molded blocks stacked on a single threaded rod. The blocks of each pair are identical, and have semi-circular cylindrical recesses which cooperate to provide circular, cable-gripping passages. The threaded rod extends in orthogonal relationship to the axes of the cable-gripping passages, through another passage located between two of the circular, cable-gripping passages.

In recent years, as high-density, high-speed backplane cable connector assembly is widely used in network, server and storage applications for high-speed data process. Generally, in high-speed transmission, the signal is transmitted by plural differential pairs with each differential pair containing two wires and it may cause miss-wiring if the pair is in the wrong direction, so a wire spacer is needed to hold and orient the plural wires. However, the cable holders mentioned foregoing are all made from two parts/halves with plural cavities formed between the parts/halves to receive one row cables therebetween, some problems may occur. Firstly, since the cable holder is a two-half structure, one half must be assembled to the other half after the cables assembled to the other half. However, there isn't any means to position the cables relative to the other half, thus, when one half assembled, the cables are prone to shift to the two halves. Secondly, the two-half structure is relatively complex in manufacture and costly in manufacture cost. These two shortcomings are not glad to be seen by the manufacturers and customers.

Hence, a cable connector assembly with an improved wire spacer is highly desired to overcome the disadvantages of the related art.

SUMMARY OF THE INVENTION

Accordingly, an object of the present invention is to provide a cable connector assembly having a wire spacer for fixing and orienting wires and making them easy to be trimmed and connected to a circuit substrate or contacts.

In order to achieve the object set forth, a cable connector assembly in accordance with the present invention comprises an insulative housing, a plurality of contacts received in the insulative housing, a plurality of wires electrically connecting with the contacts, at least a wire spacer defining a plurality of wire receiving cavities along a first direction respectively receiving the wires and at least a window in top surface communicating with the wire receiving cavities, and securing means arranged into the window securely positioning the wires within the wire receiving cavities.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
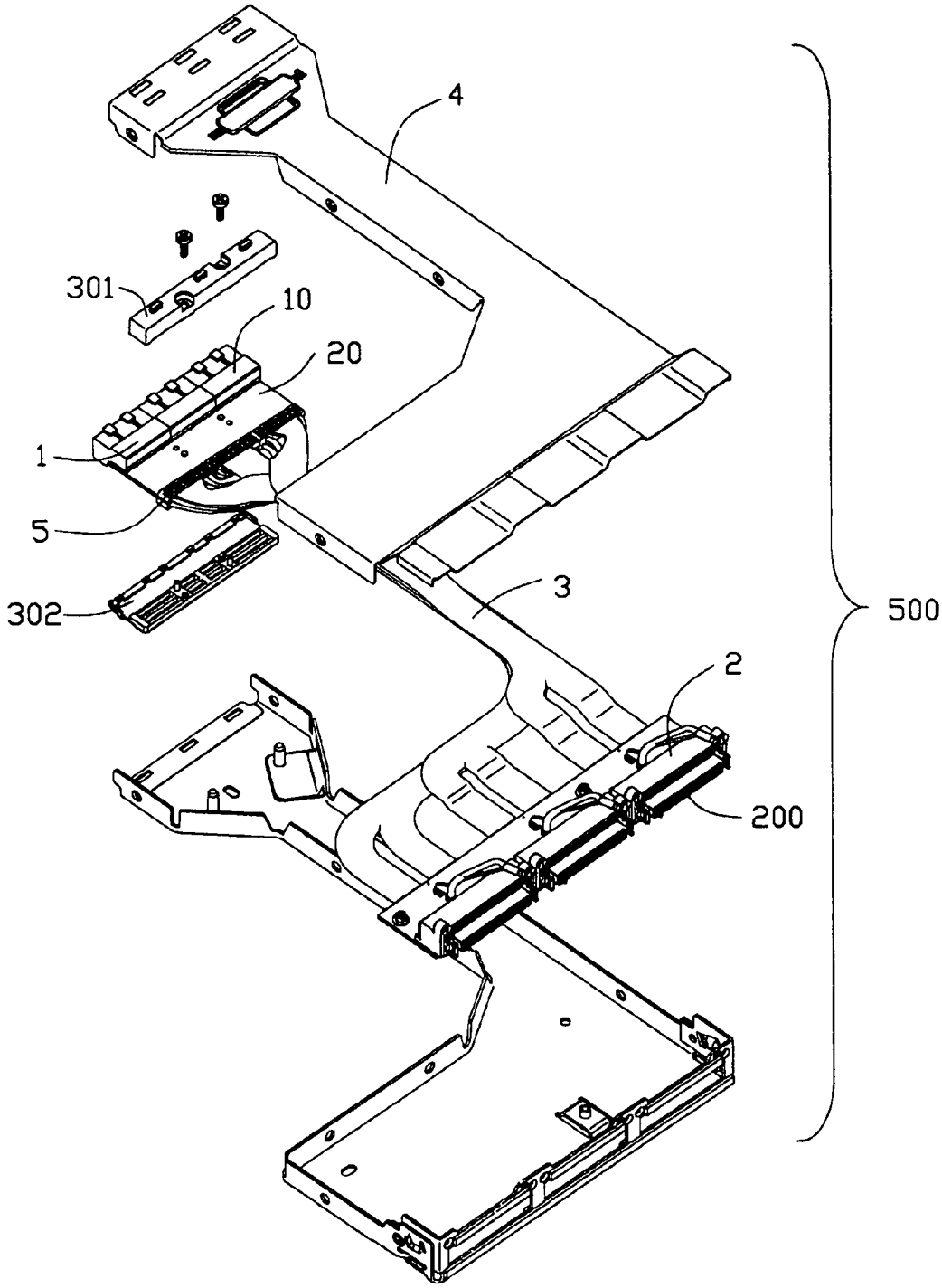
FIG. 1 is a partially exploded, perspective view of a cable connector assembly in accordance with the present invention.
Figure 2:
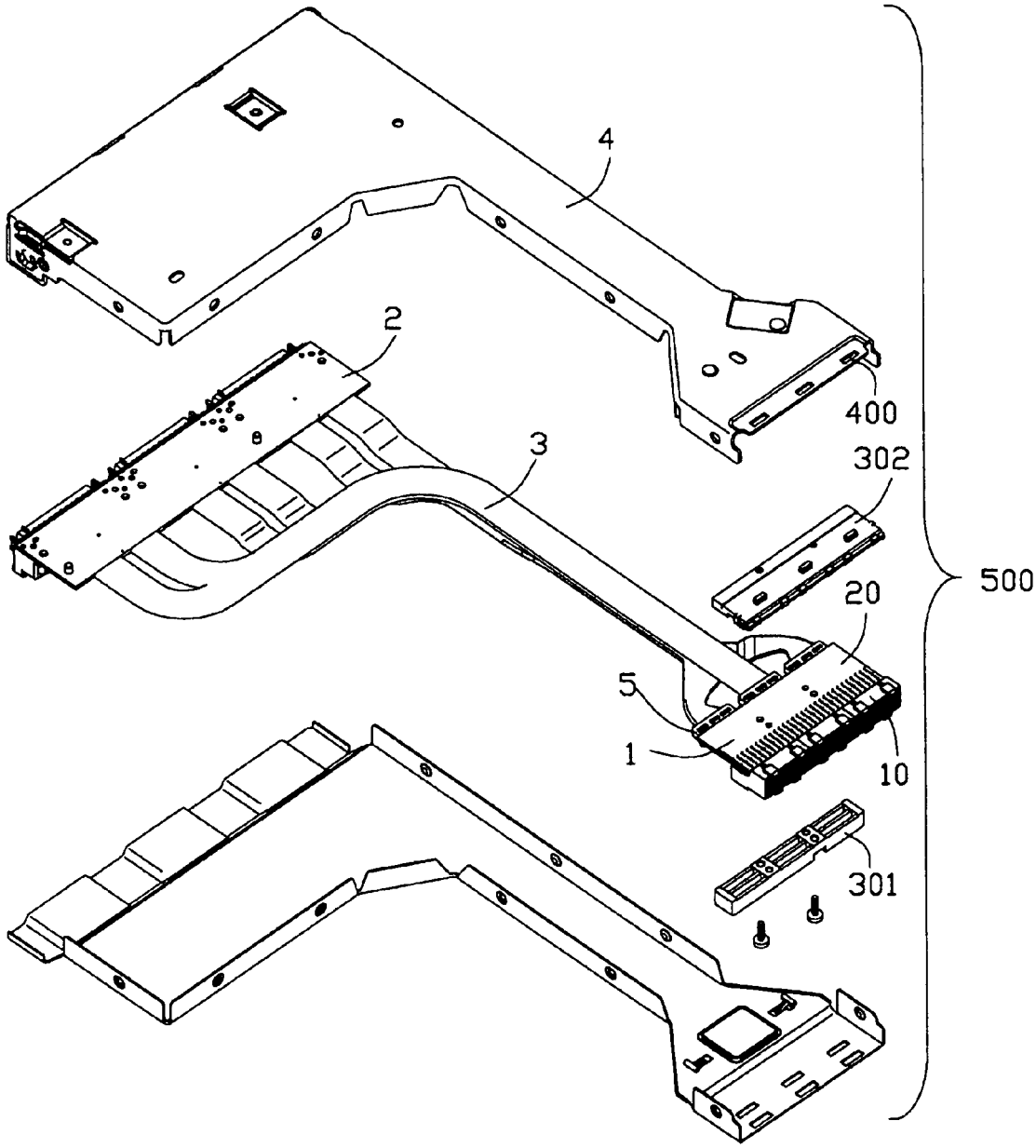
FIG. 2 is a view similar to FIG. 1, but viewed from another aspect.
Figure 3:
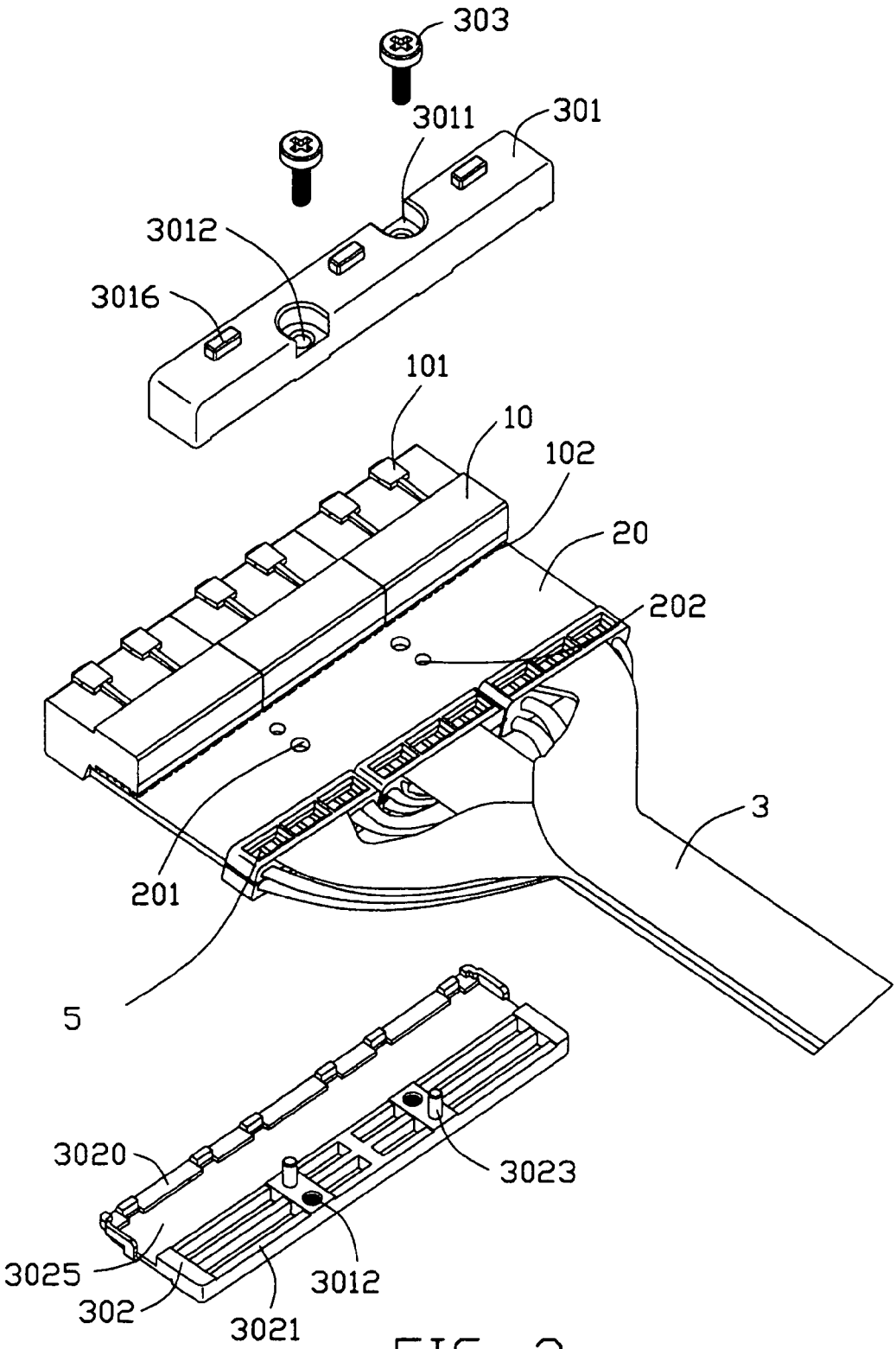
FIG. 3 is an enlarged view of a first electrical connector.
Figure 4:
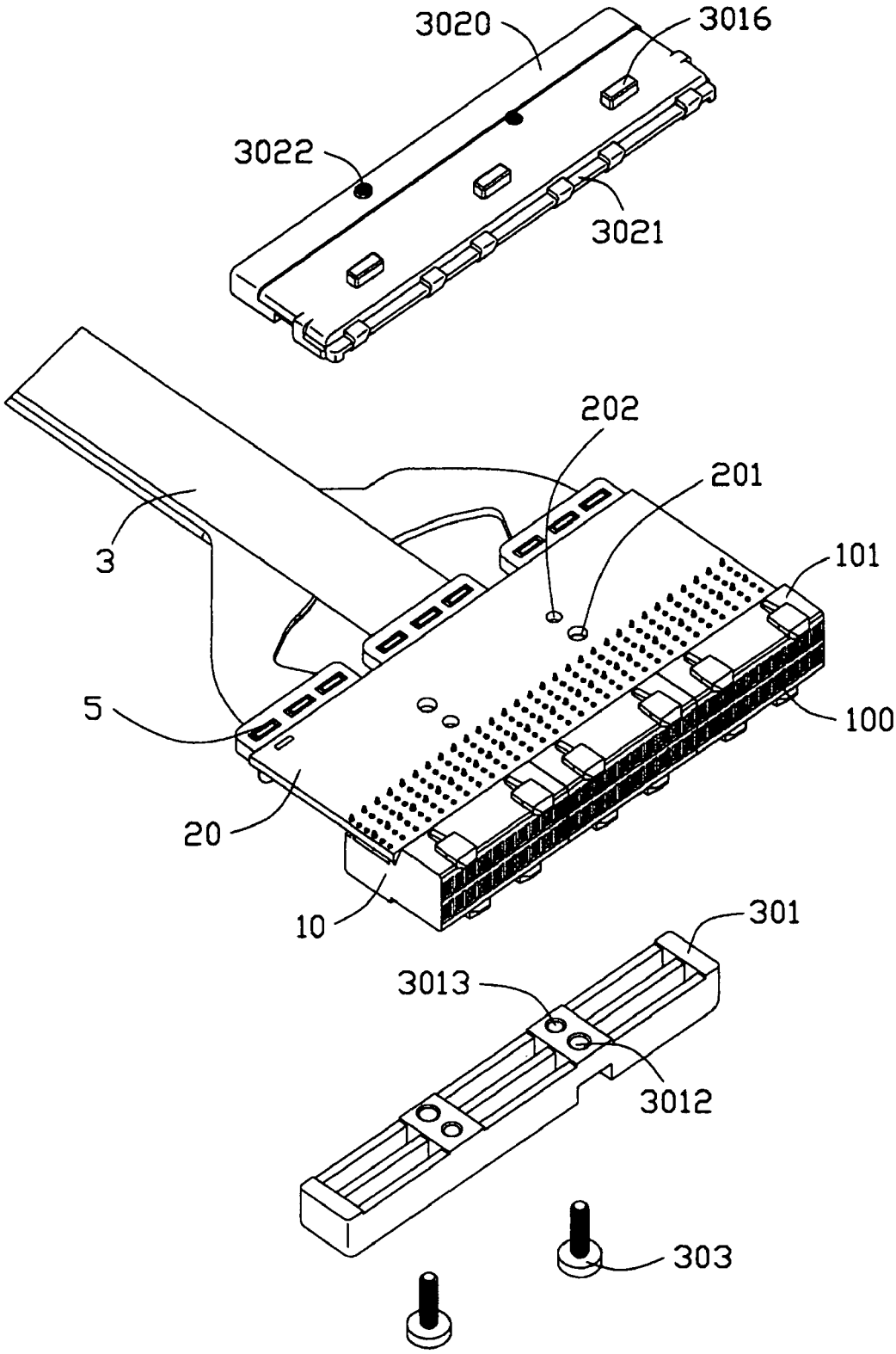
FIG. 4 is a view similar to FIG. 3, but viewed from another aspect.
Figure 6:
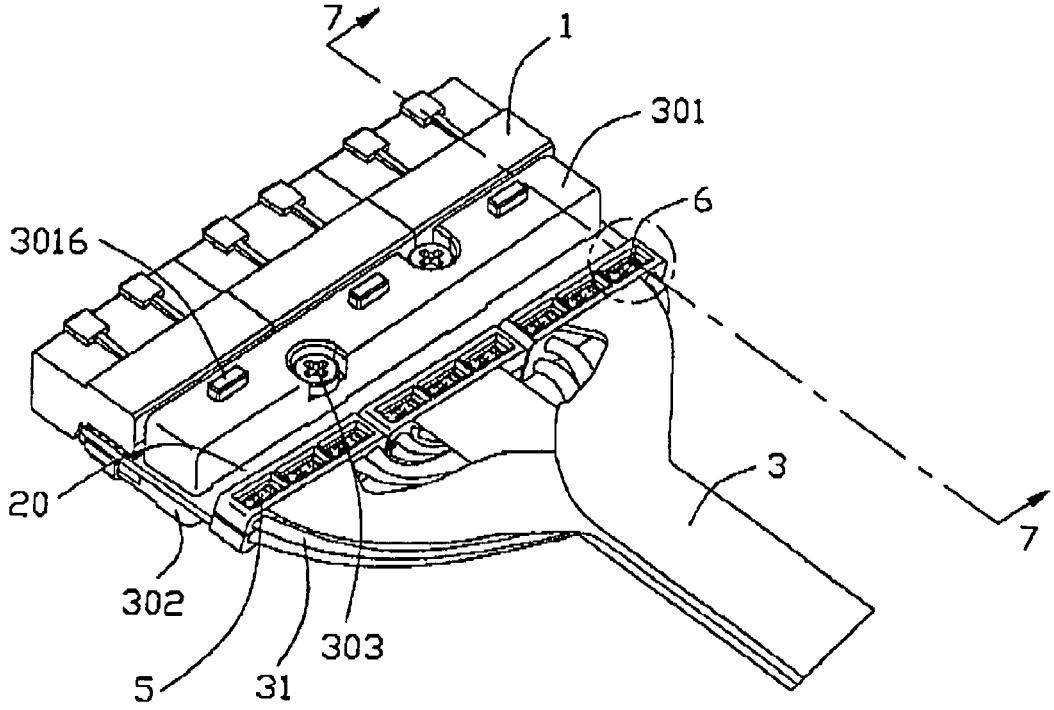
FIG. 6 is an assembled view of FIG. 3.
Figure 7:
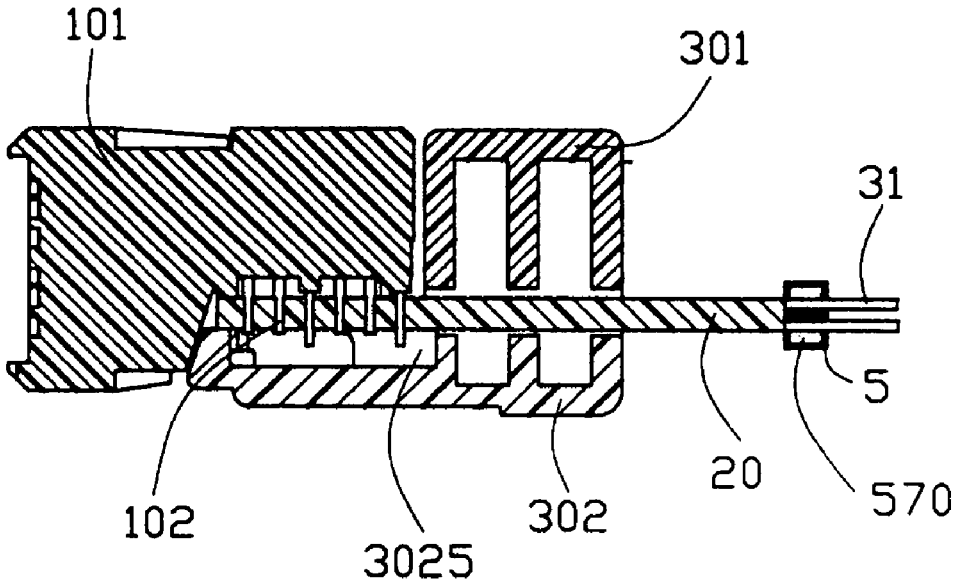
FIG. 7 is a cross-sectional view of FIG. 6 taken along line 7-7.
Figure 8:
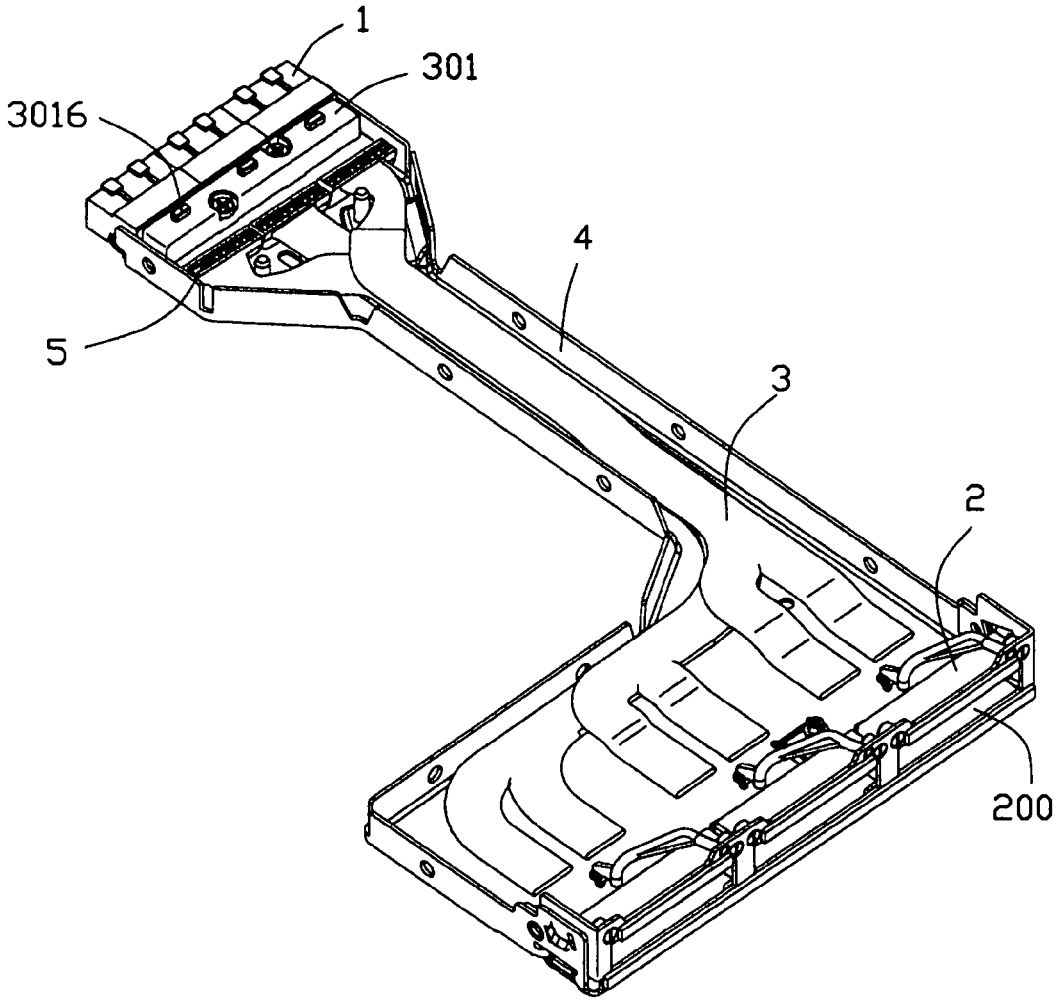
FIG. 8 is partially assembled view of FIG 1.

Referring to FIG. 1 and FIG. 2, a cable connector assembly 500 in accordance with the present invention comprises a first electrical connector 1, a second electrical connector 2, cable means 3 including a plurality of wires 31 (FIG. 6) electrically connected to the first electrical connector 1 and the second electrical connector 2, and a cover 4 forming a space (not shown) to receive the first electrical connector 1, the second electrical connector 2 and the cable means 3.

Referring to FIGS. 3, 4, 6 and 7, the first electrical connector 1 comprises a first connecting module 10, a circuit substrate 20 having circuit traces (not shown) formed thereon electrically connecting to the first connecting module 10, a reinforcing member 301/302 assembled to the circuit substrate 20 and a plurality of wire spacers 5 used for fixing and orienting the wires 31 of the cable means 3. The first connecting module 10 comprises an insulative housing 101, a plurality of contacts 102 received in the insulative housing 101 with tail portions (not labeled) extending beyond the insulative housing 101 so as to be soldered to one end portion of the circuit substrate 20. The wires 31 are used for transmitting high speed signals, thus, the wires 31 are in pairs arranged. Each pair of wires 31 respectively transmit positive and negative signals for reducing Electro Magnetic Interference (EMI) produced in signal transmission. So the wires 31 are fixed by the wire spacers 5 and electrically connected to an opposite end portion of the circuit substrate 20. A pair of first positioning holes 201 and a pair of second positioning holes 202 are defined in an area between the two end portions of the circuit substrate 20 with different sizes from each other.

The reinforcing member 301/302 is die casted from metal material or other conductive material and consists of a first half 301 and a second half 302 combinable with the first half 301 with the circuit substrate 20 sandwiched therebetween by a pair of screws 303. The second half 302 is wider than the first half 301 along front-to-back direction and comprises a front portion 3020, a rear portion 3021 with a width equal to that of the first half 301 and a depression 3025 defined between the front and the rear portions 3020, 3021. When the contacts 102 are soldered to the circuit substrate 20, the tail portions of contacts 102 and the soldering dots will be received in the depression 3025 to prevent shirt circuit. The first half 301 and the rear portion 3021 of the second portion 302 respectively define a pair of screw holes 3012 aligning with the pair of first positioning holes 201 for permitting the screws 303 passing therethrough. The rear portion 3021 forms a pair of positioning posts 3023 protruding upwardly therefrom and in alignment with the second positioning holes 202. The first half 301 defines a pair of receiving grooves 3013 for receiving the positioning posts 3023 of the second half 302. Both the first half 301 and the rear portion 3021 of the second half 302 comprise three fixing protrusions 3016 spaced arranged on outer surfaces thereof. Since the circuit substrate 20 is constrained by the first and the second halves 301, 302 assembled thereto, when the first electrical connector 1 is mated/unmated with/from the complementary connector, the circuit substrate 20 is unlikely to be shifted by force exerted on the first cable connector 1 during mating/unmating, that is, the connecting module 10 is more reliable relative to conventional backplane connector.

Figure 5:
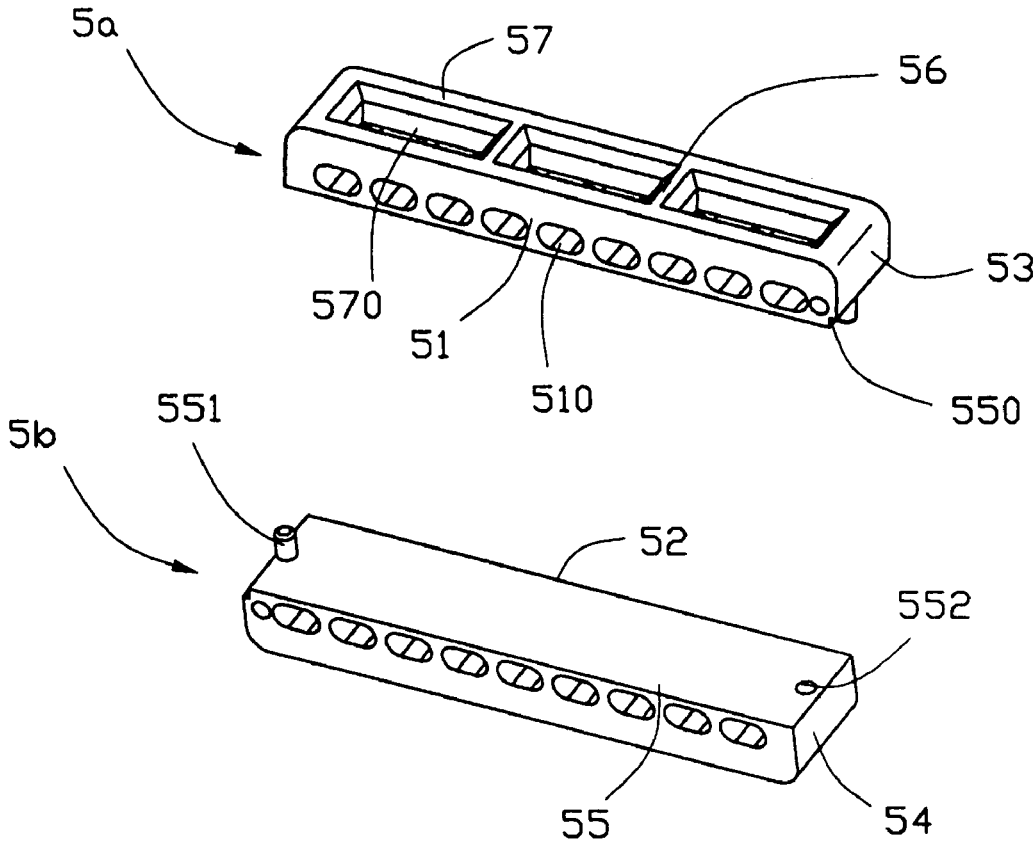
FIG. 5 is an enlarged view of a wire spacer.

Referring to FIG. 5, the wire spacer 5 is made from insulated material and is composed of a first holding half 5*a* and a second holding half 5*b* combinable with the first holding half 5*a*. The first holding half 5*a* and the second holding half 5*b* are hermaphroditic, each holding half 5*a*/5*b* has an elongate body portion defining a front and a rear walls 51, 52 and a pair of transversal side portions 53, 54 interconnecting a top surface 57 and a bottom side portion 55 respectively. A plurality of wire receiving cavities 510 extending through the front and the rear walls 51, 52 along a first direction (front-to-back direction). The wire receiving cavities 510 are aligned in a row along a second direction perpendicular to the first direction and located adjacent to the bottom side portion 55. A plurality of rectangular windows 570 are recessed downwardly from the top surface 57 and communicate with the wire receiving cavities 510. The windows 570 are separated from one another by a plurality of land portions 56. A post 551 and a circular recess 552 are respectively formed on opposite end portions of the bottom side portion 55, and a cutout 550 is defined at junction between the transversal side portion 53 and the bottom side portion 55. When the first holding half 5*a* is assembled to the second holding half 5*b*, the post 551 or circular recess 552 of the first holding half 5*a* and the circular recess 552 or the post 551 of the second holding half 5*b* can mate with each other, and the first holding half 5*a* and the second holding half 5*b* can combine together reliably by the friction between the posts 551 and the circular recesses 552. It should be known that the first holding half 5*a* and the second holding half 5*b* may be combined together by screws or other means.

When the wires are aligned only in a row, the first/second holding half serves as the wire spacer. Firstly, each wire 31 (FIG. 6, FIG. 7) of the cable means 3 is inserted into a corresponding wire receiving cavity 510 of the wire spacer 5 and extends out of the cavity 510 respectively, then, glue 6 or other adhesive material is applied to the windows 570, so the wires 31 are positioned reliably in the wire receiving cavities 570. Secondly, the wires 31 are trimmed, such as cutting and removing part of the insulation of the wires 31 to expose inner conductors outside. Thirdly, the wires 31 are connected to the circuit trace of the circuit substrate 20.

In the embodiment of the present invention, the wires 31 aligned in upper and lower rows are received in the cavities 510 of the first holding and the second holding halves 5*a*, 5*b*. Each wire 31 received in the cavity 510 of the first holding half 5*a* respectively aligned wit the wire 31 received in the cavity 510 of the second holding half 5*b* form a differential pair and a plurality of differential pairs aligned in a row along the second direction. The first holding half 5*a* is combined with the second holding half 5*b* to serve as the wire spacer 5. Thus, the differential pairs of the wires 31 are respectively correctly oriented and positioned. Firstly, the first holding half 5*a* is assembled to the second holding half 5*b* with the posts 551 aligning with the circular recesses 552, and the first and the second halves 5*a*, 5*b* are stayed together stably by the interference between the posts 551 and the circular recesses 552. Secondly, the wires 31 are put into the wire receiving cavities 10 of the first holding half 5*a* and the second holding half 5*b* respectively with each wire receiving cavity 510 receiving a wire 31 along the first direction, then glue 6 or other adhesive material is apply to the windows 5 and the wires 31 are securely positioned and oriented within the wire receiving cavities 510, thus, the wire spacer 5 receives two rows of wires 31. Thirdly, a force is exerted to the pair of cutouts 550 to separate the wire spacer 5 into the first holding half 5*a* and the second holding half 5*b*, and the wires 31 received in the first holding half 5*a* and the second holding half 5*b* are trimmed, respectively. Lastly, the first holding half 5*a* is assembled to the second holding half 5*b* again and the wires 31 are connected to the circuit substrate 20.

Figure 9:
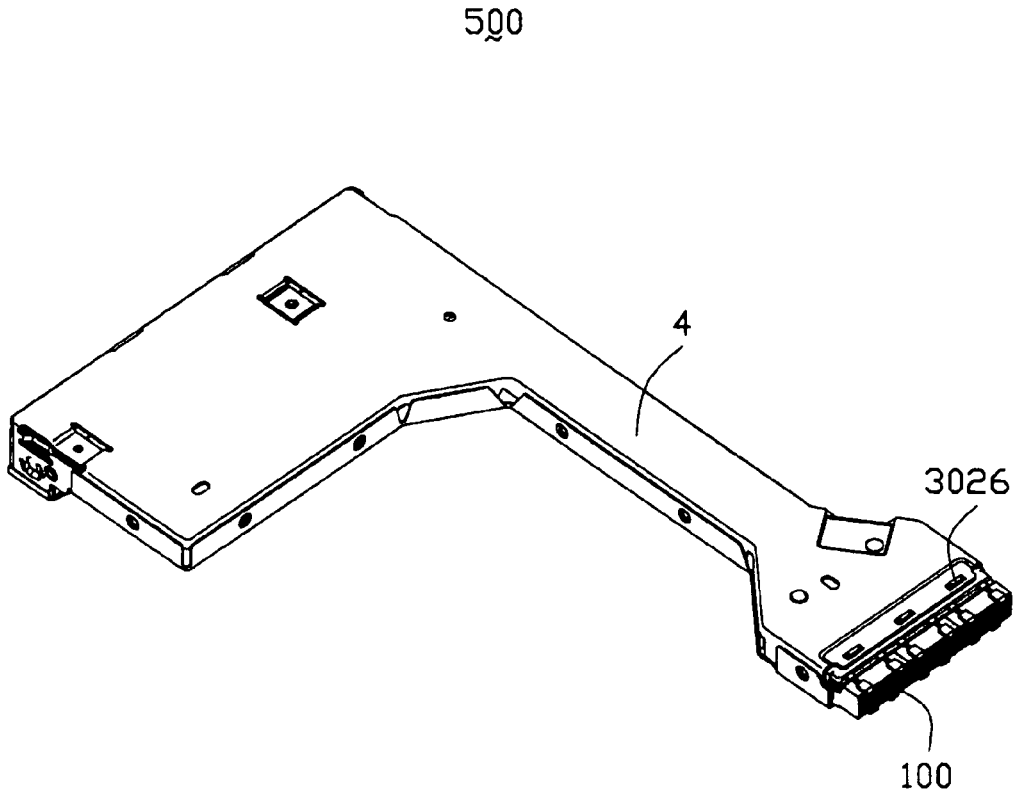
FIG. 9 is an assembled, perspective view of the cable connector assembly in FIG 2.
Figure 10:
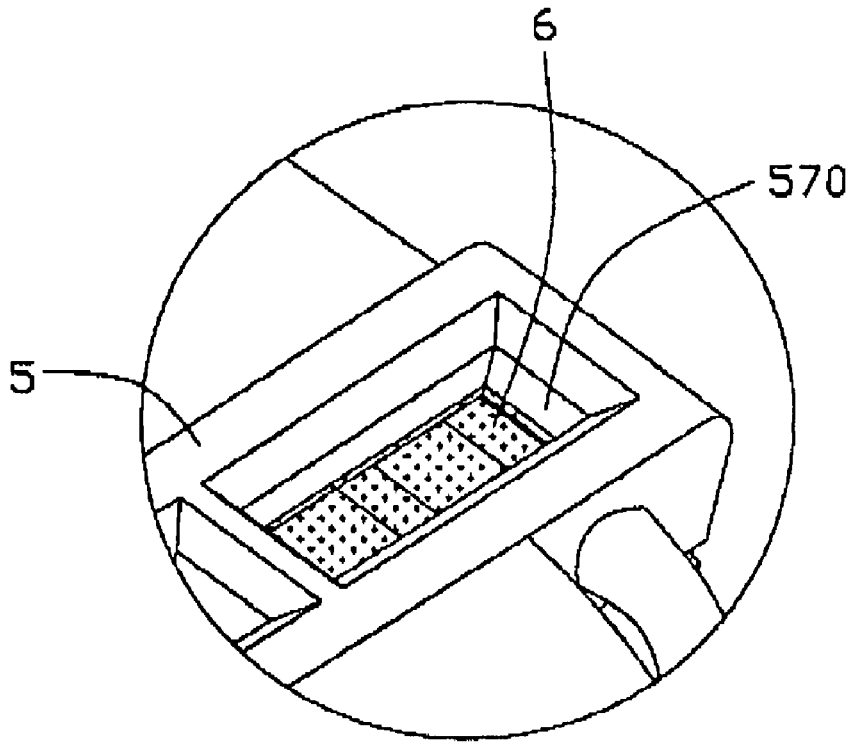
FIG. 10 is an enlarged view of an encircled portion of FIG 6.

Referring to FIGS. 1-2 and in conjunction with FIG. 9, the cover 4 is made of metallic material and formed of an upper cover and a lower cover. The upper cover and the lower cover respectively define a plurality of locating holes 400 for engaging with corresponding fixing protrusions 3016 of the reinforcing member 301/302 for shifting the force that is exerted on the first electrical connector 1 during mating/unmating to the cover 4.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing;

a plurality of contacts received in the insulative housing adapted for electrically connecting with a complementary connector;

a plurality of wires electrically connecting with the contacts;

at least a wire spacer defining a plurality of wire receiving cavities each extending along a first direction and the wire receiving cavities aligned in a row along a second direction perpendicular to the first direction respectively receiving the wires, and at least a window in top surface communicating with the wire receiving cavities; and securing means arranged into the window adapted for securely positioning and correctly orienting the wires within the wire receiving cavities.

2. The cable connector assembly as claimed in claim 1, wherein the wire spacer consists of a first holding half and a second holding half combination with the first holding half, and wherein each holding half receives a row of wires therein.

3. The cable connector assembly as claimed in claim 2, each holding half defines a plurality of windows to communicate with the wire receiving cavities, and wherein the windows are spaced from one another by a plurality of land portions.

4. The cable connector assembly as claimed in claim 2, wherein each holding half defines a post and a circular recess on a bottom side portion and the post of one half interferes with the circular recess of the other half.

5. The cable connector assembly as claimed in claim 2, wherein a cutout is defined at junction between a transversal side portion and a bottom side portion of the wire spacer separating the wire spacer into the two holding halves conveniently.

6. The cable connector assembly as claimed in claim 2, wherein the wire received in the first holding half aligned with the wire received in the second holding half together form a differential pair to respectively transmit positive and negative signals.

7. The cable connector assembly as claimed in claim 1, further comprising a circuit substrate having circuit traces telemetrically connecting with the contacts and the wires.

8. The cable connector assembly as claimed in claim 1, wherein the securing means is glue applied to position the wires within the wire receiving cavities.

9. The cable connector assembly as claimed in claim 1, further comprising a reinforcing member securely assembled to circuit substrate, and further comprising a cover cooperating with the reinforcing member to position the circuit substrate.

10. The cable connector assembly as claimed in claim 8, wherein the cover is composed of an upper cover and a lower cover combined together to form a space to receive the housing, the circuit substrate, the reinforcing member and the wire spacer.

11. The cable connector assembly as claimed in claim 8, wherein the reinforcing member consists of two halves with the circuit substrate sandwiched between the two halves.

12. The cable assembly as claimed in claim 8, wherein the reinforcing member is die casted from metal material with a depression adapted for receiving tail portions of contacts and soldering dots to preventing short circuit.

13. A wire spacer, comprising:

an elongate body defining a front and a rear walls and a pair of transversal side portions interconnecting a top surface and a bottom side portion respectively, a plurality of wire receiving cavities extending between the front and the rear walls and aligned in a row adapted for permitting wires passing through, the body further defining a window in the top surface in communication with the wire receiving cavities; and securing means arranged into the window adapted for securely positioning each wire within the wire receiving cavity.

14. The wire spacer as claimed in claim 13, wherein each wire receiving cavity extends along a first direction and the window extending downwardly from the top surface to communicate with the wire receiving cavities.

15. The wire spacer as claimed in claim 13, wherein the wire spacer is composed of two halves combined together and receiving two rows of the wires.

16. The wire spacer as claimed in claim 15, wherein each half defines a post and a circular recess on the bottom side portion and the post of one half interferes with the circular recess of other half.

17. The wire spacer as claimed in claim 15, wherein a cutout is defined at junction between the transversal side portion and the bottom side portion for separating the holder into two halves conveniently.

18. The wire spacer as claimed in claim 13, wherein securing means is glue applied to position the wires within the wire receiving cavities.

19. A cable connector assembly comprising:

a housing providing a mating interface;

a printed circuit board located behind the housing;

a plurality of wires connected to a rear region of the printed circuit board;

a wire organizer located behind the printed circuit board and defining a plurality of passages extending therethrough in a front-to-back direction so as to allow the corresponding wires to extend therethrough; wherein at least one window is formed in the wire organizer to expose at least one of said passages in a transverse direction for access or inspection.

* * * * *